US008286286B2

(12) United States Patent
Al-Saif

(10) Patent No.: US 8,286,286 B2
(45) Date of Patent: Oct. 16, 2012

(54) PRAYER CUSHION FOR USE DURING ISLAMIC RITUAL PRAYERS

(76) Inventor: Nadia M. Al-Saif, St. Rashed Burisly (KW)

( * ) Notice: Subject to any disclaimer, the term of this patent is extended or adjusted under 35 U.S.C. 154(b) by 0 days.

(21) Appl. No.: 12/555,339

(22) Filed: Sep. 8, 2009

(65) Prior Publication Data

US 2011/0056020 A1 Mar. 10, 2011

(51) Int. Cl.
*A47C 17/86* (2006.01)

(52) U.S. Cl. ..... 5/648; 5/420; 5/630

(58) Field of Classification Search ..... 5/630, 648–651, 5/417, 420, 652, 655.9, 656, 632, 730, 740, 5/902; 297/423.1, 423.11, 423.39, 423.41; D6/382, 595, 596, 601
See application file for complete search history.

(56) References Cited

U.S. PATENT DOCUMENTS 2,448,427 A * 8/1948 Gordon ..... 280/32.5
2,748,838 A * 6/1956 Scholl ..... 297/423.41
4,060,863 A * 12/1977 Craig ..... 5/644
4,766,627 A * 8/1988 Landry ..... 5/652.1
4,824,089 A * 4/1989 Dickhudt et al. ..... 5/648
D355,096 S * 2/1995 Lang ..... D6/608
5,546,310 A * 8/1996 Ehdaie et al. ..... 701/207
6,185,768 B1 * 2/2001 Schlechter ..... 5/632
6,298,508 B1 * 10/2001 McCloskey ..... 5/632
6,578,217 B1 * 6/2003 Roberson ..... 5/632
6,763,537 B1 * 7/2004 Crear ..... 5/636
6,783,822 B1 * 8/2004 Faouaz ..... 428/34.1
6,810,541 B1 * 11/2004 Woods ..... 5/420
7,188,381 B2 * 3/2007 Lombert ..... 5/648
7,246,391 B2 * 7/2007 Brown ..... 5/648
2003/0019007 A1 * 1/2003 Spencer ..... 2/24
2008/0222789 A1 * 9/2008 Pfeiffer ..... 4/571.1

* cited by examiner

*Primary Examiner* — Robert G Santos
*Assistant Examiner* — Nicholas Polito
(74) *Attorney, Agent, or Firm* — Lowe Hauptman Ham & Berner, LLP

(57) ABSTRACT

A prayer cushion for use during Islamic ritual prayers to reduce pain and black marks on an individual's knees and ankles comprises a generally rectangular pad of hollow polyester fibers with a soft cotton layer on top of the hollow polyester fibers. The pad has a width of about 50 cm, a length of 25 to about 50 cm and an thickness of about 14 cm. The pad also defines two relatively short longitudinally extending floor engaging channels extending from a rear edge of the cushion and is adapted to receive a portion of an individual's foot therein. The channels also have a height of about 8 cm and width of about 12 cm and extend for a length that will accommodate a portion of an individual's foot.

1 Claim, 6 Drawing Sheets

PRAYER CUSHION FOR USE DURING ISLAMIC RITUAL PRAYERS

FIELD OF THE INVENTION

This invention relates to a prayer cushion for use during Islamic ritual prayers and more particularly to prayer cushions for reducing pain and the formation of black marks on the ankles and knees of individuals.

BACKGROUND FOR THE INVENTION

"Salaat," the Islamic ritual prayer is an obligatory worship for each Muslim. The obligation is to pray five times a day, namely "Fajer" before the sun rises, "Thoher" at noon, "Aser" afternoon, "Magreb" when the sun sets, and "Isha" at night. During each prayer, the Islamic worshiper exercises prostrate 34 times and sit on their ankles for extended periods of time.

Many Islamic worshipers extend their prayers to include non-obligatory prayers in addition to the obligatory prayers to reach 50 prostrates during a day or even more during the days of the holy month of Ramadan. During such acts, worshipers suffer from pain at their ankles and at the lower part of their legs. At the same time, worshipers noted the emergence of a dark black spots at the ankles and knees (bruising) resulting from the continued contact and friction with carpets on rigid floors. This in turn has adversely affected a women's appearance.

Some worshipers have attempted to use a normal cushion or pillows during prayers to reduce friction and pain. However, such attempts have been less than satisfactory. The cushion and pillows were less than convenient and failed to cover all areas of friction, were uncomfortable during the prostrate and sitting positions and at times made it difficult to maintain ones balance. Further, the cushions and pillows were not easy to carry.

In view of the above, it has now been determined that there is a need and a potential market for a customized prayer cushion that meets the needs of Muslims and is at the same time compact, convenient to carry, and convenient to use. It is also been found that a prayer cushion in accordance with the present invention reduces pain in the ankles and lower legs of worshipers, facilitates prayer and leads to a more meaningful experience on the part of the worshiper.

BRIEF SUMMARY OF THE INVENTION

In essence, the present invention contemplates a prayer cushion for use during Islamic ritual prayers to reduce pain in a worshipers ankles and lower legs and to eliminate the formation of black marks (bruising) on the individual's knees and ankles. The prayer cushion comprises a generally rectangular pad of hollow polyester fibers and a layer of soft cotton on top of the hollow polyester fibers. The cushion in accordance with the present invention has the width of approximately 50 cm, a length of between about 25 cm and about 50 cm and a thickness of about 14 cm. The cushion also defines two longitudinally extending floor engaging channels extending forwardly from the rear edge of the cushion. The channels may be relatively short in length and only need to accommodate a portion of the worshiper's feet. The channels also each have a width of about 12 cm and a height of about 8 cm.

The invention will now be described in connection with the accompanying drawings wherein like reference numerals have been used to indicate like parts.

DESCRIPTION OF THE PREFERRED EMBODIMENTS OF THE INVENTION

In performing "Salaat" the Islamic ritual prayer an individual should recognize that the individual's body, clothes and place of prayer must be clean. The worshiper then performs wudu, the ritual ablution. Women are required to cover their hair and their whole body except for their face and hands and to face the Qibla (the direction of Mecca). The individual then stands erect with their head down, hands at sides and feet evenly spaced, and express their intent to perform Salaat.

To begin the Salaat, worshipers stand, puts the world behind them and brings his/her hands to his ears with palms forward and thumbs behind the earlopes and say God is Great in Arabic.

Figure 1:
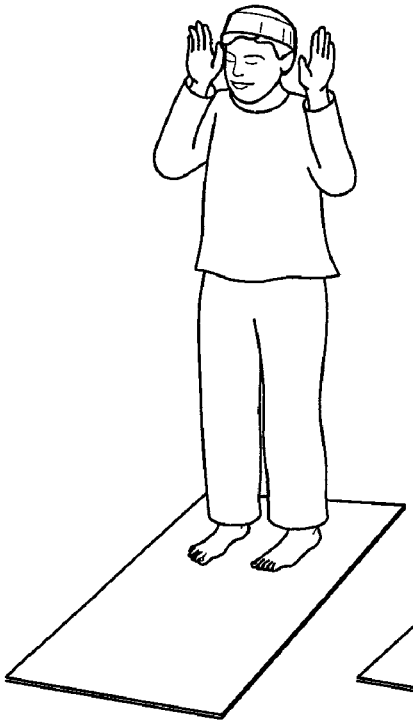
FIG. 1 illustrates the position of a worshiper's body at the beginning of Salaat.
Figure 2:
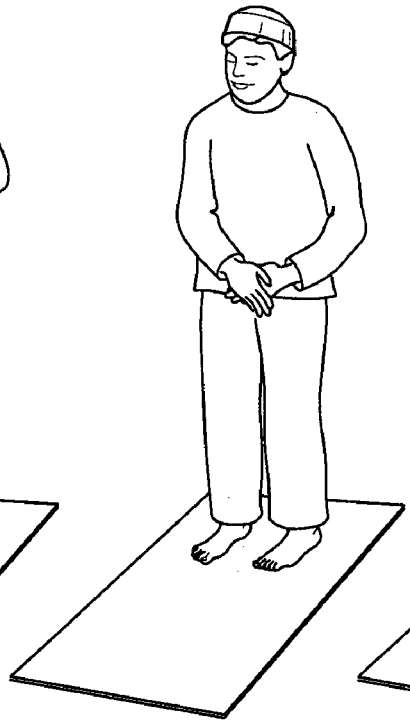
FIG. 2 illustrates the position of a worshiper's body during Qiyam.

The worshiper then places his/her right hand over his left, men below the navel, women at chest level, look at the ground in front of him/her and recite the Opening Supplication (see for example FIGS. 2 and 3).

Figure 3:
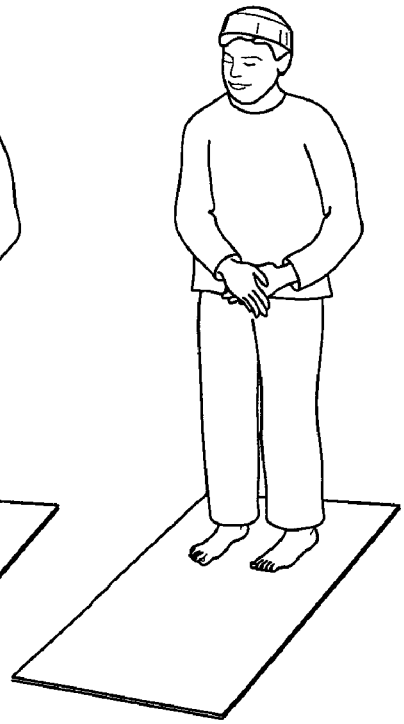
FIG. 3 illustrates the position of a worshiper's body during Fatiha.
Figure 4:
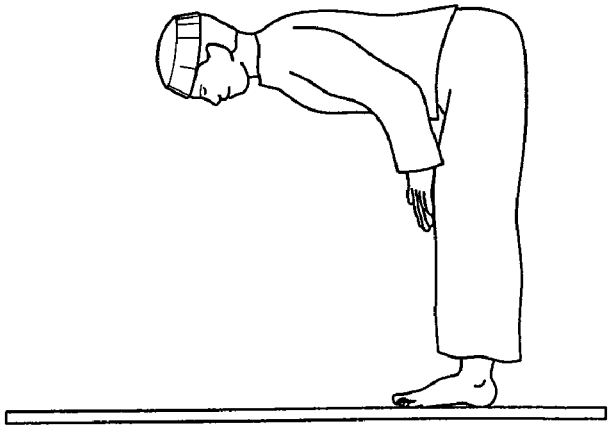
FIG. 4 illustrates the position of a worshipers' body during Ruk'u.
Figure 5:
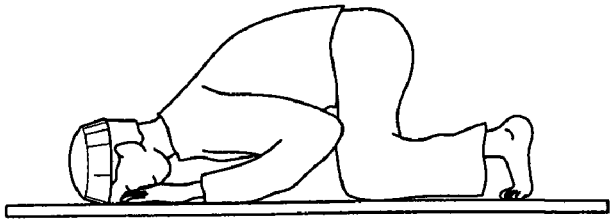
FIG. 5 illustrates the position of a worshiper's body during Sudjood.
Figure 9:
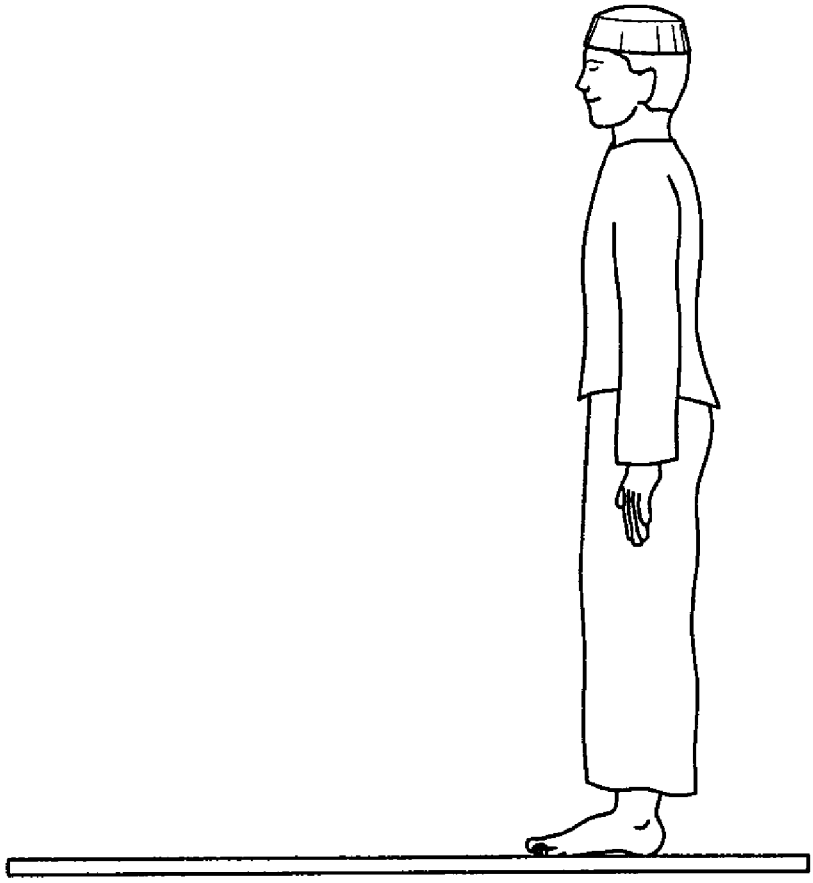
FIG. 9 illustrates the position of a worshiper's body during Fatiha.
Figure 10:
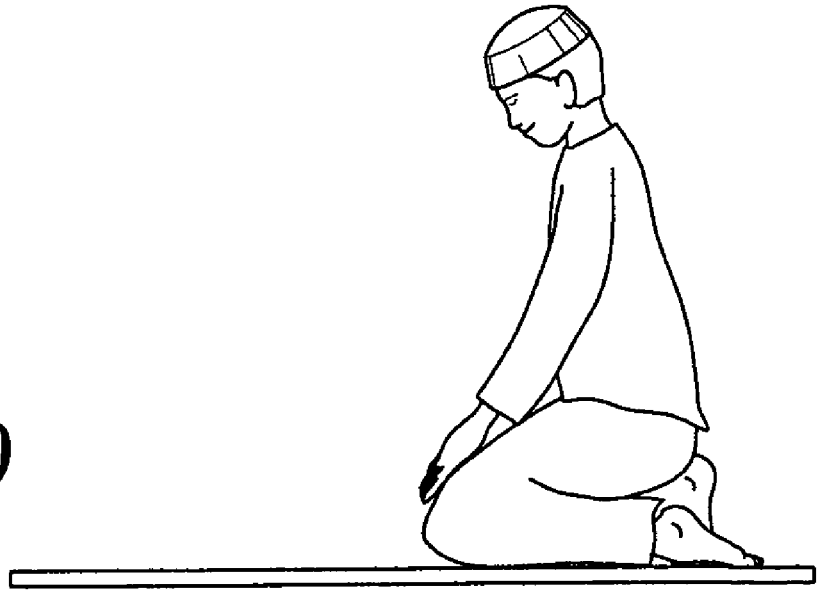
FIG. 10 illustrates the position of a worshiper's body during a third Rakat.
Figure 11:
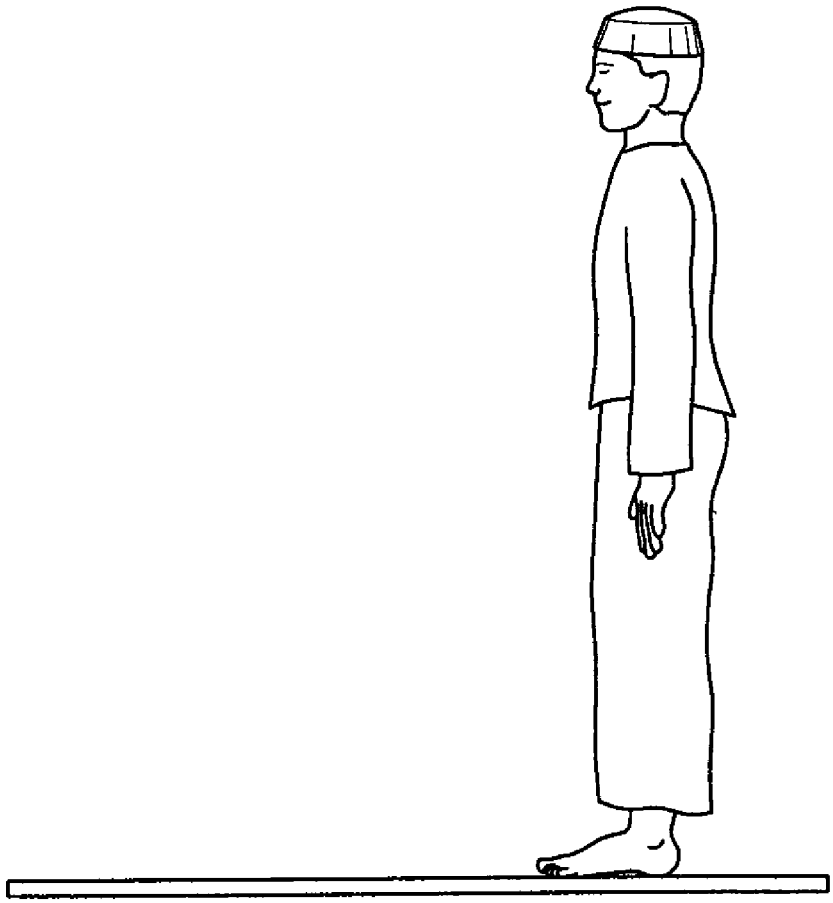
FIG. 11 illustrates the position of a worshiper's body during recitation of the Fatiha.

Referring now to FIG. 3, recital allowed the Fatiha the first Surah of the Qur'an. At this point refer to FIG. 3. At this point the worshiper's hands drop to their sides, they bend from the waist placing palms on knees with back parallel to the ground and look at their feet as shown in FIG. 4. Following this position, the worshiper raises from bending to standing with arms at side as shown in FIG. 9 and recites the Qauma and continues on to the Sudjood. In this position the worshiper is prostrate with hands on knees, lowers himself slowly to the kneeling position touches the forehead, nose and palms to the ground (but not the elbows), bends the toes so the top of the feet face the Qibla (please refer to FIG. 5).

Figure 6:
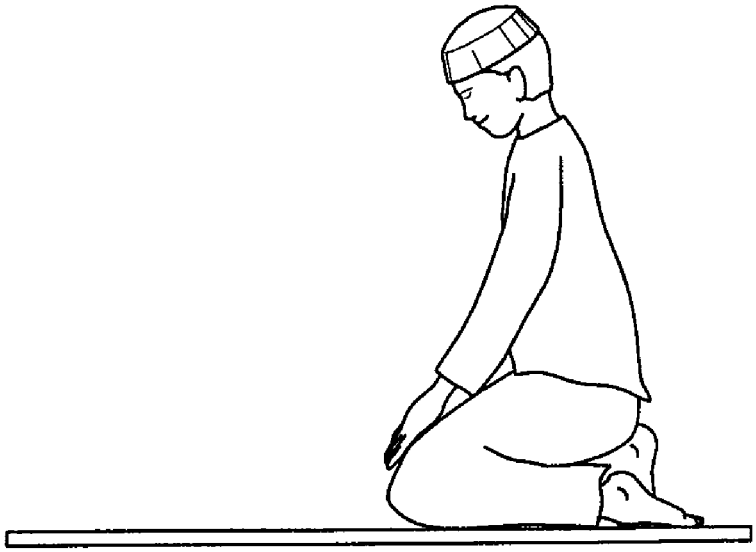
FIG. 6 illustrates the position of a worshiper's body during Qu'ud.
Figure 7:
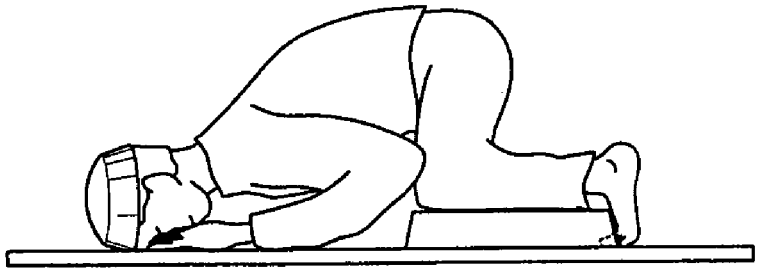
FIG. 7 illustrates the position of a worshiper's body during Sudjood.
Figure 8:
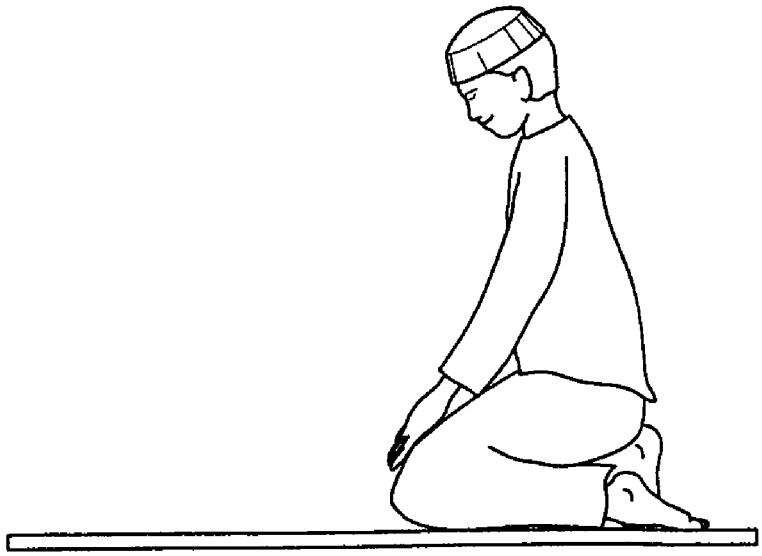
FIG. 8 illustrates the position of a worshiper's body during Qu'ud.

In the Qu'ud the worshiper raises to a sitting position looking at the lap, men turn up the heel of the right foot, with right toes bent while women keep both feet, soles up under the body in a flat position as shown in FIG. 6. From this position the worshiper moves back to the Sudjood prostrate again as shown in FIG. 7 that is followed by rising to the sitting position shown in FIG. 8.

Figure 12:
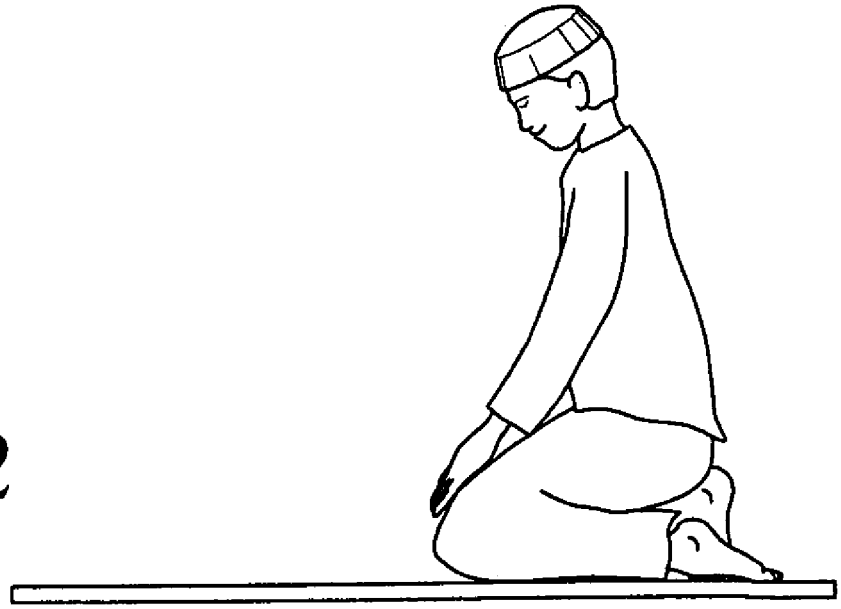
FIG. 12 illustrates the position of a worshiper's body during recitation of At-Tashahhud and the Salawat.

By completing the above steps the worshiper will complete one Raka-a, depending on the prayer type and time, the worshiper will repeat the above steps 2 times for "AlFajer" prayer, 3 times for "Magreb" prayer and 4 times for "Thoher", "Aser" and "Isha" prayers. After any two "Raka-a" in all prayers, the worshiper will be seated as shown in FIG. 12 and recite "Altashahhud".

Figure 13:
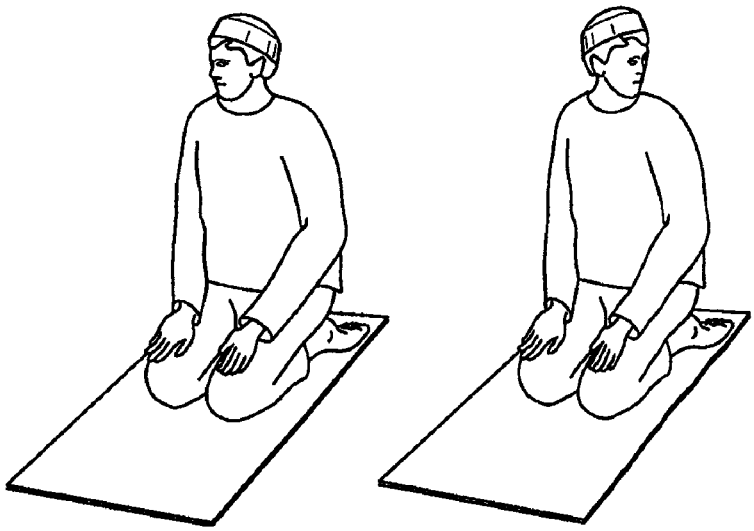
FIG. 13 illustrates the position of the worshiper's body upon completion of their prayers.
Figure 14:
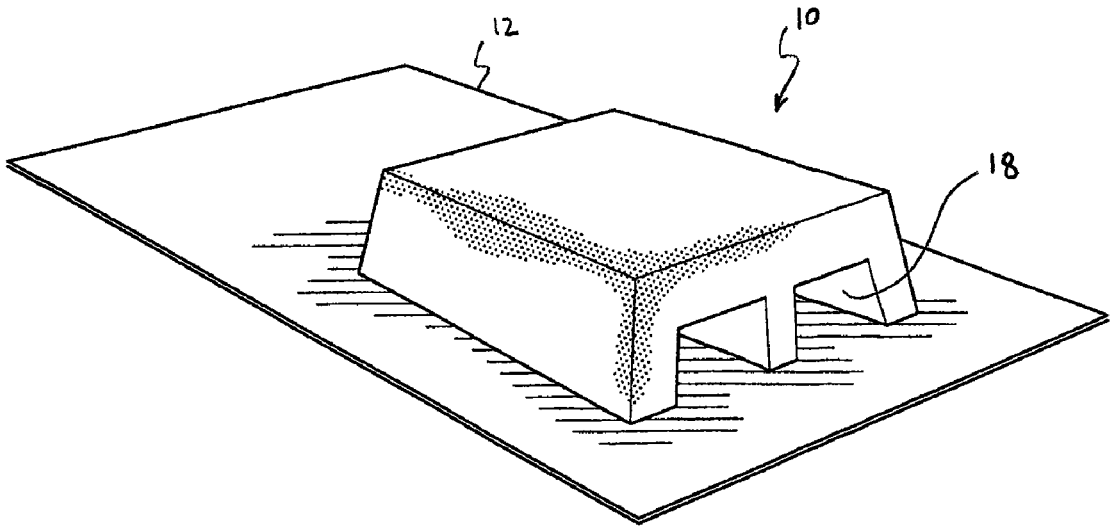
FIG. 14 is perspective view of a prayer rug in accordance with a preferred embodiment of the present invention.
Figure 15:
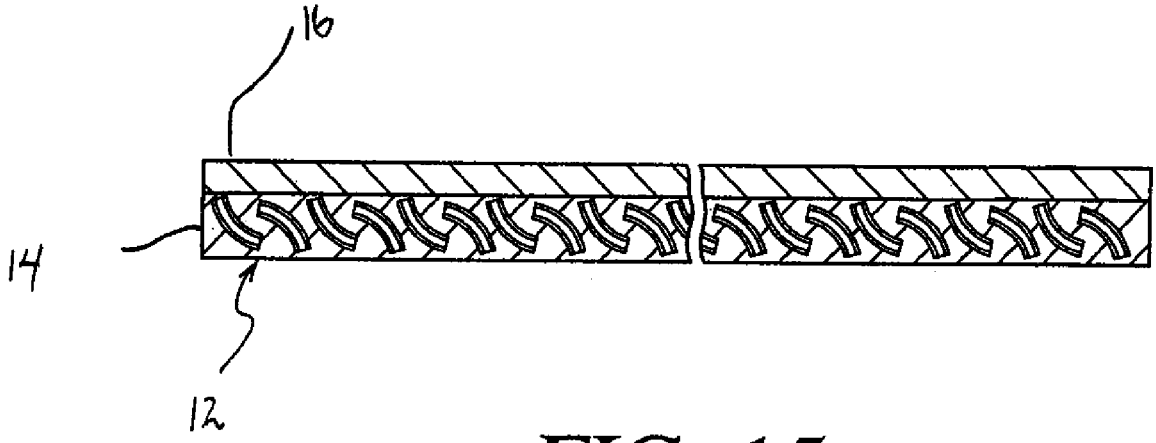
FIG. 15 is a side sectional view of the prayer rug in accordance with a preferred embodiment of the present invention.

FIG. 13 illustrates the position of the worshiper's body upon completion of their prayers and FIG. 14 is a perspective view of prayer cushion generally illustrated at 10 in accordance with a preferred embodiment of the present invention. As shown in FIGS. 14 and 15, the prayer cushion 10 for use during Islamic ritual prayers to reduce pain and black marks on an individual's knees and ankles, the cushion comprises a pad 12 having a generally rectangular top surface, a generally rectangular base and a trapezoidal shaped cross section and wherein said pad is of hollow polyester fibers 14 with a layer of soft cotton 16 on top of the hollow polyester fibers 14. The pad or cushion has a width of about 50 cm and a length of between about 25 cm to about 50 cm with a thickness of about 14 cm and in which the cushion defines two longitudinally extending floor engaging channels 18 extending forwardly from a rear edge of the cushion and wherein each of the channels have a width of about 12 cm and a height of about 8 cm and are adapted to receive a portion of an individual's feet during prayers.

While the invention has been described in connection with its preferred embodiments it should be recognized that changes and modifications may be made therein without departing from the scope of the appended claims.

What is claimed is:

1. A prayer cushion and prayer rug assembly for use during Islamic ritual prayers to reduce pain and bruising on an individual's knees and ankles, said cushion being placed on to of said rug and consisting of a pad having a generally rectangular top surface, a generally rectangular base and a trapezoidal prism shaped cross section and configuration wherein said pad is of hollow polyester fibers and a layer of soft cotton on top of said hollow polyester fibers and wherein said pad has a width of about 50 cm, a length of between about 25 cm to about 50 cm and a thickness of about 14 cm and in which said pad defines two parallel longitudinally extending channels extending forwardly from a rear edge of said cushion and wherein each of said parallel channels has a width of about 12 cm and a height of about 8 cm and, wherein said parallel channels are adapted to receive a portion of an individual's foot and engage an arched upper surface of the foot between the rug and the cushion during prayers.

* * * * *